US008479360B2

(12) United States Patent
Vera

(10) Patent No.: US 8,479,360 B2
(45) Date of Patent: Jul. 9, 2013

(54) CLAMPS FOR FABRICS

(76) Inventor: Elmer V. Vera, American Canyon, CA (US)

( * ) Notice: Subject to any disclaimer, the term of this patent is extended or adjusted under 35 U.S.C. 154(b) by 493 days.

(21) Appl. No.: 12/751,006

(22) Filed: Mar. 31, 2010

(65) Prior Publication Data

US 2011/0088215 A1 Apr. 21, 2011

Related U.S. Application Data

(60) Provisional application No. 61/279,070, filed on Oct. 16, 2009.

(51) Int. Cl.
*B25G 3/32* (2006.01)

(52) U.S. Cl.
USPC ..... 16/422; 5/83.1; 5/81.1 HS; 5/81.1 T

(58) Field of Classification Search
USPC ..... 16/110.1, 422, 436, 430, 411, 406, 16/DIG. 24, DIG. 25; 5/81.1 R, 83.1, 88.1, 5/84.1, 81.1 HS, 81.1 T, 89.1; 294/140
See application file for complete search history.

(56) References Cited

U.S. PATENT DOCUMENTS 2,821,739 A * 2/1958 Mohs ..... 16/411
D362,181 S * 9/1995 Meyers et al. ..... D9/434
5,920,929 A * 7/1999 Hensley et al. ..... 5/81.1 T
6,349,432 B1 * 2/2002 Scordato et al. ..... 5/81.1 R
6,532,610 B1 * 3/2003 Calfas et al. ..... 5/626
6,615,423 B2 * 9/2003 Sverdlik et al. ..... 5/81.1 C
6,629,323 B2 * 10/2003 Sverdlik et al. ..... 5/81.1 C
6,662,388 B2 * 12/2003 Friel et al. ..... 5/86.1
7,111,338 B2 * 9/2006 Faux et al. ..... 5/81.1 HS
7,725,964 B2 * 6/2010 Minning et al. ..... 5/81.1 R
8,087,109 B2 * 1/2012 Hillenbrand, II ..... 5/81.1 HS
2008/0276430 A1 * 11/2008 Sharpe ..... 16/430

* cited by examiner

*Primary Examiner* — William L. Miller

(74) *Attorney, Agent, or Firm* — Antonio Papgeorgiou Ostrow Kaufman LLP

(57) ABSTRACT

A clamp that attached to fabrics is provided that includes a tubular member and a locking member. The tubular member has an elongated tubular shape with a lengthwise slot disposed therein between a first end and a second end longitudinally opposite the first end, and a protrusion that extends out of an inner surface of a lengthwise cavity within the tubular member. The protrusion is disposed within the tubular member biased toward one side of the slot to create an asymmetrical cross section in the tubular member. The locking member has thickness smaller than a width in the slot and a width greater than the width in the slot allowing the locking member to be inserted into and out of the slot in a first orientation but not in at least one other orientation.

18 Claims, 19 Drawing Sheets

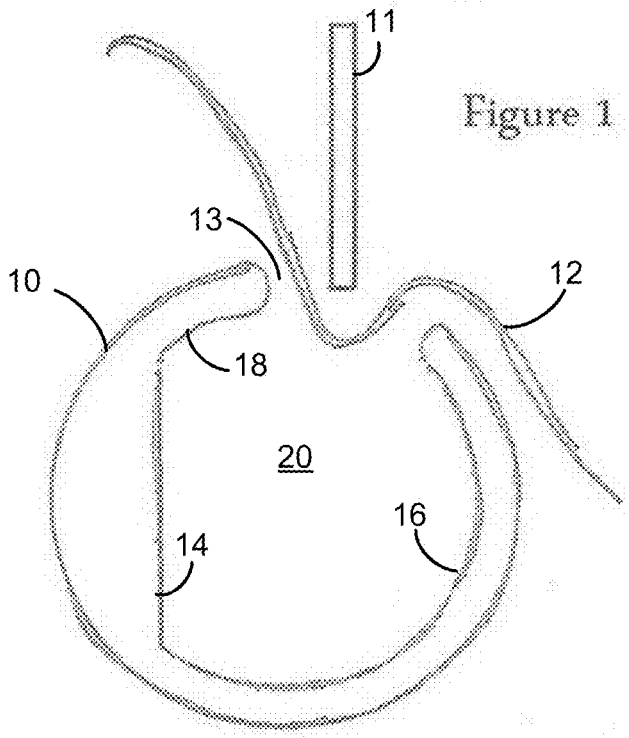
Figure 1
Figure 2
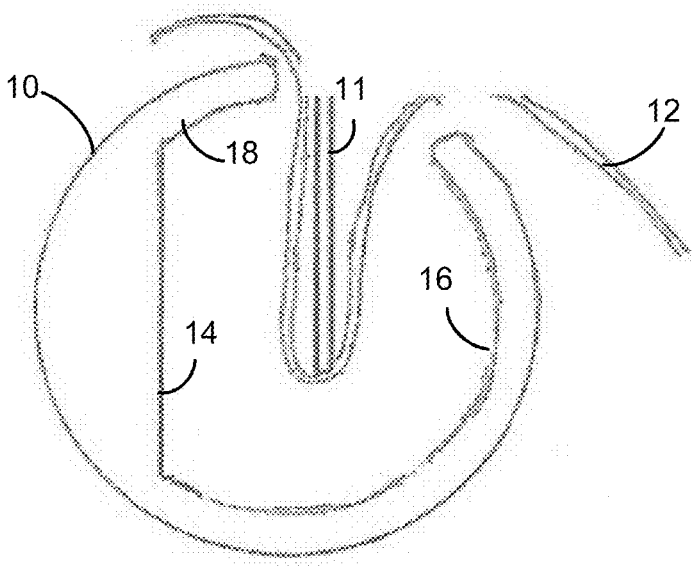

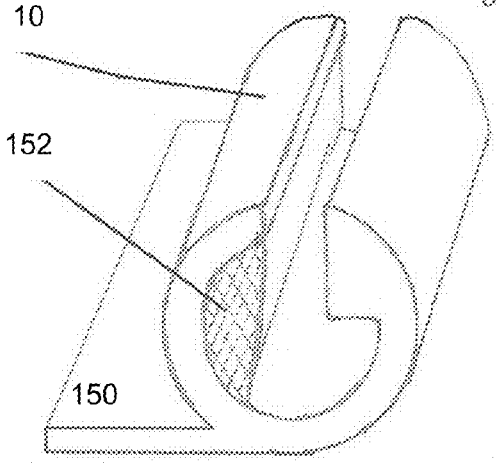
Figure 15.A
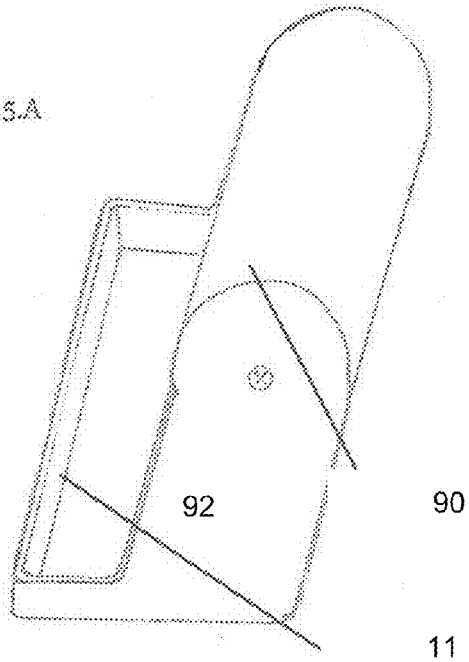
Figure 15.B
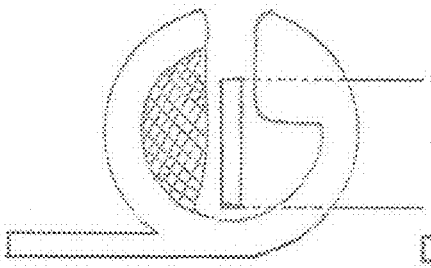
Figure 15.C
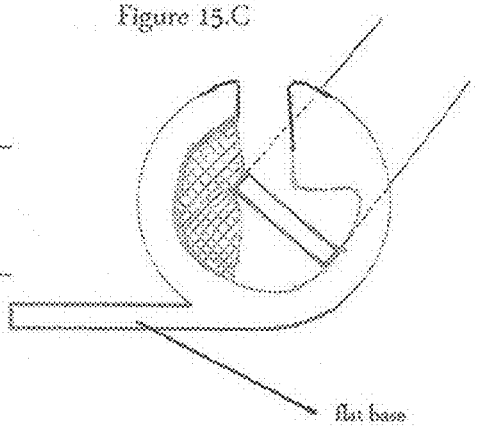
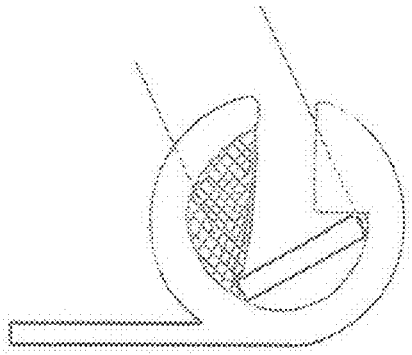
Figure 15.D

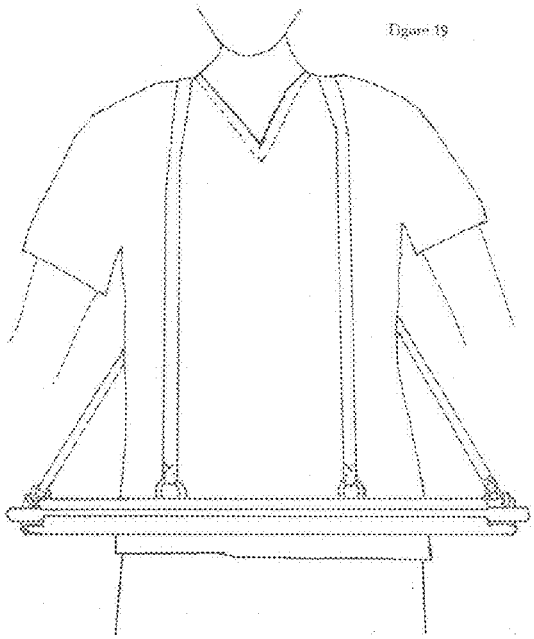
Figure 19
Figure 20 A
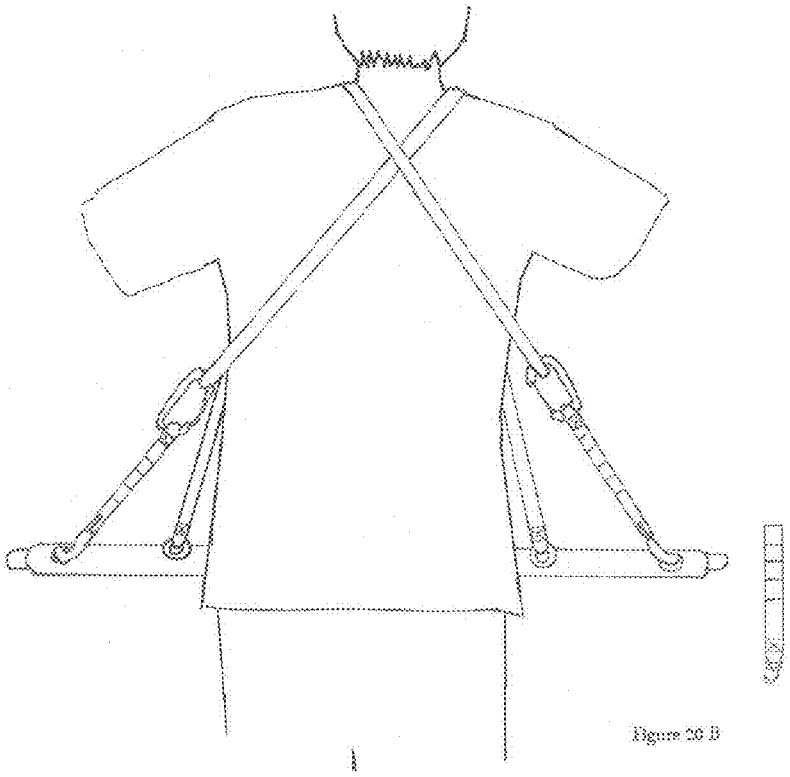
Figure 20 B

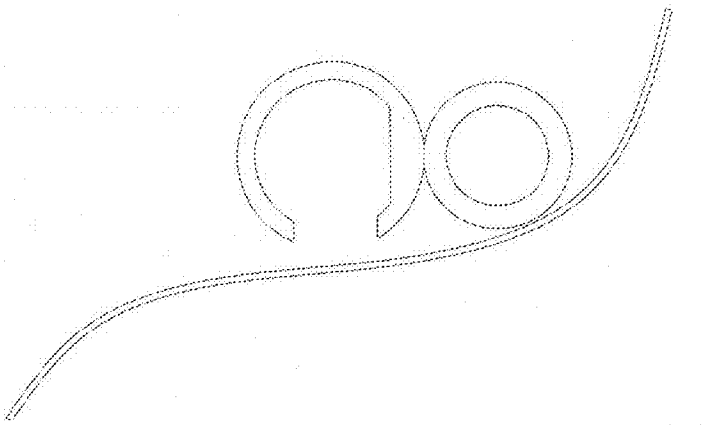
Figure 23
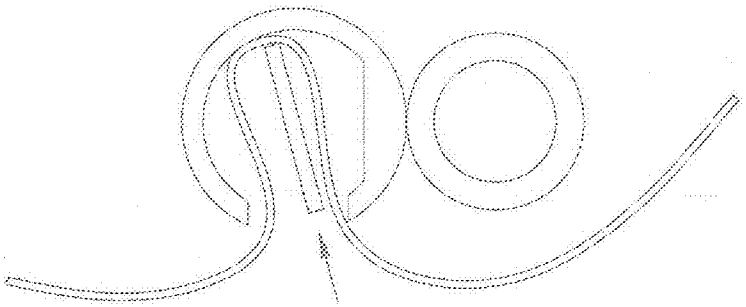
Figure 24
FIGURE 3

CLAMPS FOR FABRICS

RELATED APPLICATION

This application claims the benefit of U.S. Provisional Patent Application No. 61/279,070, filed Oct. 16, 2009, which is hereby incorporate herein by reference.

BACKGROUND

The present application relates generally to clamping mechanisms and more particularly to clamps that secure to fabrics.

In 2007, with 8,580 total cases of musculoskeletal injuries, direct care registered nursing ranked seventh among all occupations where musculoskeletal injuries resulted in days away from work. Also in 2007, nursing aides, orderlies, and attendants sustained 24,340 musculoskeletal injuries, the second highest of any occupation. The physical demands of the nursing profession lead many nurses to leave the profession. Moreover, fifty-two percent of nurses complain of chronic back pain and thirty-eight percent suffer from pain severe enough to require leave from work.

The leading cause of these injuries is the result of lifting, transferring, and repositioning of patients. According to William Marras, a leading biomechanics researcher from Ohio State University, "What makes patient lifting difficult is that employees cannot use their leg muscles because they are leaning over the edge of the bed. They have to use their back muscles to haul the patients up, and that's not easy."

In the hospital, nurses use a pull sheet to reposition patients using their bare hands. Pulling the patient that is lying down laterally toward the head of the bed requires at least two people each of whom position him or herself on either side of the bed. Each person then grabs the lateral ends of the pull sheet that has been positioned underneath the patient, followed by a quick pull of the sheet in the desired direction, e.g., towards the head of the bed. To reposition a patient on his or her side, one employee reaches over the patient to the opposite side of the bed and pulls on the lateral end of the sheet over the patient and in a direction toward the employee thereby causing the patient to tilt in that direction. Another person can then place pillows behind the patient's back to maintain the patient on his or her side. These motions place the nurses in precarious situations which may lead to lower back, shoulder, arm, and wrist injuries.

Accordingly, there is a need for devices and methods of using these devices that assist users in moving and repositioning patients with a pull sheet or with any other fabric that reduce the risk of these and other types of injuries.

SUMMARY OF THE INVENTION

A clamp or clamps attachable to fabrics are provided herewith that when used help reduce the risk of back injury as a result, e.g., of lifting or repositioning a patient. This is generally accomplished with clamps that in one embodiment may be secured to a pull sheet or other fabric in a manner that allows users to maintain an essentially erect posture while lifting or repositioning patients. In this respect, the user of the clamps disclosed herein is able to use his or her leg muscles for these activities, which provides better leverage for lifting and repositioning patients, and/or eliminates or otherwise reduces stress on areas of the user's body that are prone to injury. Additionally or alternatively, the clamps may be further coupled to a lift or lifting mechanism that further assists users with lifting and repositioning patients. Although the clamp or clamps of the present application may be discussed herein in relation to lifting or repositioning patients, it is understood that these clamps can be used to lift any object.

An object of one or more embodiments of the clamps discussed herein is to provide a clamp that secures to fabrics, preferably quickly and easily.

Another object of one or more embodiments of the clamps discussed herein is to provide a clamp that secures to fabric with sufficient clamping force to withstand the pulling force applied thereto.

Another object of one or more embodiments of the clamps discussed herein is to provide a clamp that secures to a fabric and withstands any jostling that may be encountered when lifting and repositioning objects.

Another object of one or more embodiments of the clamps discussed herein is to provide a clamp that when properly used will not tear the fabric or damage the integrity of the fabric in either a loaded or unloaded state.

Other objects and advantages of the present invention will become apparent to the reader and it is intended that these objects and advantages are within the scope of the present disclosure.

One or more of these objects or any other object is accomplished with a clamp that includes a tubular member and a locking member. The tubular member has an elongated tubular shape with a lengthwise slot disposed therein between a first end and a second end longitudinally opposite the first end, and a protrusion that extends out of an inner surface of a lengthwise cavity within the tubular member, the protrusion disposed within the tubular member biased toward one side of the slot to create an asymmetrical cross section in the tubular member. The locking member has thickness smaller than a width in the slot and a width greater than the width in the slot allowing the locking member to be inserted into and out of the slot in a first orientation but not in at least one other orientation.

In at least one embodiment, the tubular member has a cylindrical shape.

In at least one embodiment, the first and the second ends are open. In this instance, the slot may extend longitudinally along an entire length of the tubular member between the first and second openings.

In at least one embodiment, the slot is essentially parallel to a lengthwise axis of the tubular member.

In at least one embodiment, the locking member is a flattened, elongated bar having a length equal to or greater than a length of the tubular member.

In at least one embodiment, the tubular member has an essentially circular inner surface, the protrusion extends outward from the essentially continuous inner surface, and wherein the locking member is inserted into the tubular member such that one end of the locking member abuts against an intersection of the protrusion and a major inner surface section, and another end of the locking member abuts against the major inner surface section at another point in the inner surface. In this instance, the protrusion may extend in a direction in line with the slot for the entire length of the tubular member.

In at least one embodiment, the locking member includes at least one handle extending out of one longitudinal end of the locking member.

In at least one embodiment, the locking member includes a pair of struts each extending out of a longitudinal end of the locking member and a grip disposed between the struts, wherein the locking member has a planar surface and wherein the pair of struts extend out of the planer surface at an angle so that the grip is above the planer surface and offset relative to a centerline of the planar surface.

In at least one embodiment, the tubular member comprises a flat base and wherein the slot is disposed in the tubular member vertically above the base.

In at least one embodiment, the tubular member comprises a cushion disposed within the cavity of the tubular member lengthwise opposite the protrusion.

In at least one embodiment, clamp further comprises a locking pin, and wherein the tubular member includes a pair of holes cross drilled therein to accept the locking pin and to lock the locking member in place within the cavity of the tubular member.

In at least one embodiment, the tubular member comprises at least one loop attached to the tubular member at a point on an outer surface of the tubular member opposite the protrusion.

One or more of these objects or any other object is accomplished with a clamp that includes a tubular member and a locking member. The tubular member has an elongated tubular shape with a lengthwise slot disposed therein extending longitudinally along an entire length of the tubular member between a first open end and a second open end longitudinally opposite the first end, and a protrusion that extends out of an inner surface of a lengthwise cavity within the tubular member, the protrusion disposed within the tubular member biased toward one side of the slot to create an asymmetrical cross section in the tubular member. The locking member is a flat, elongated bar having a length equal to or greater than a length of the tubular member, a thickness smaller than a width in the slot, and a width greater than the width in the slot allowing the locking member to be inserted into and out of the slot in a first orientation but not in at least one other orientation.

One or more of these objects or any other object is accomplished with a method of attaching a clamp to a fabric, the method including the steps of: positioning a tubular member having a lengthwise slot disposed therein extending longitudinally along an entire length of the tubular member between a first open end and a second open end longitudinally opposite the first end so that the slot faces upward, the tubular member having a protrusion that extends out of an inner surface of a lengthwise cavity within the tubular member, the protrusion disposed within the tubular member biased toward one side of the slot to create an asymmetrical cross section in the tubular member; positioning the fabric above the slot in the tubular member; inserting the fabric into the tubular member with a locking member having a length equal to or greater than a length of the tubular member, a thickness smaller than a width in the slot, and a width greater than the width in the slot; and turning in a first direction the tubular member therewith pinching the fabric between one end of the locking member and an intersection of the protrusion and a major inner surface section, and another end of the locking member and at another point on the major inner surface section.

In at least one embodiment, the method further includes the step of turning the locking member further in the first direction therewith causing the tubular member to rotate and pull a tension in the fabric.

In at least one embodiment, the method further includes the step of turning the locking member in an opposite direction therewith releasing the fabric from the clamp.

Additional aspects of the present invention will be apparent in view of the description that follows.

BRIEF DESCRIPTION OF THE FIGURES

FIG. 1 to FIG. 4 are a side views of a clamp according to at least one embodiment of the clamps discussed herein;

FIG. 15 to FIG. 16 are perspective and side views of a clamp according to at least another embodiment of the clamps discussed herein;

FIG. 17 to FIG. 21 are perspective and side views of a clamp according to at least another embodiment of the clamps discussed herein;

FIG. 22 to FIG. 26 are perspective and side views of a clamp according to at least another embodiment of the clamps discussed herein.

DETAILED DESCRIPTION OF THE INVENTION

Figure 3:
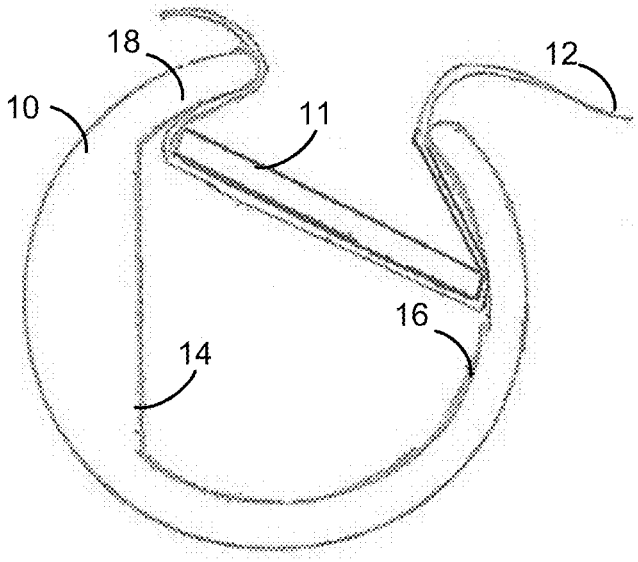

The present application generally provides a clamp that secures to a pull sheet or any fabric quickly and easily, and preferably with little or no impact on the fabric being clamped. Referring to FIGS. 1-6, a clamp according to at least one embodiment of the clamps disclosed herein includes an elongated member 10 and a locking member 11. These two members generally include interlocking geometry that firmly attaches the clamp to a fabric 12 placed in between the two members 10, 11. In at least one embodiment, the tubular member 10 has an elongated tubular shape, cylindrical or otherwise, with a lengthwise slot 13 therein. The tubular member 10 further has a first open end and a second open end longitudinally opposite the first open end. The lengthwise slot 13 preferably extends longitudinally the whole length, e.g., from the first open end to the second open end, or a portion thereof of the tubular member 10. The slot 13 may be essentially parallel to the axis of the tubular member 10 as shown.

In at least one embodiment, the elongated tubular member 10 includes a cavity 20 therein, as shown in FIG. 1, which creates an inner surface. The inner surface has geometry in cross section that interlocks with a complementary geometry associated with the locking member 11. In at least one embodiment the inner surface includes at least one protrusion 14 that breaks up or generally sticks out of the otherwise continuous inner surface. For example, the inner surface may have an essentially circular cross sectional shape and the protrusion may be defined by a line in that cross section that extends out of the circular inner surface's cross section, as shown. The protrusion 14 is preferably offset with respect to the slot 13. That is, when slot 13 is oriented vertically upward, the protrusion is biased toward one side to create an asymmetrical cross section in the tubular member 10. In this way, the protrusion 14 is flanked on either end by a minor 18 and major 16 inner surface sections. The protrusion 14 extends preferably in a direction in line with the slot 13. The protrusion 14 in the inner surface may also extend longitudinally the whole length or a portion thereof of the tubular member 10.

The locking member 11 generally has a shape and size that allows it to fit through the slot 13 of the tubular member 10 in a first orientation, but not in another orientation. For example, the locking member 11 may be a flattened, elongated bar having a thickness and a width. In this instance, the thickness of the locking member 11 is smaller than the width of the slot 13, which allows the locking member 11 to be inserted into the slot 13. The width of the locking member 11 is larger than the opening of the slot 13, which prevents the locking member 11 from being pulled out of the tubular member 10 when rotated clockwise or counterclockwise about the longitudinal axis of the tubular member 10. The locking member is preferably equal to or slightly longer than the length of the tubular member. The locking member may be comprised of various configurations and sizes, and may be longer or shorter than the tubular member 10 in certain embodiment.

Figure 4:
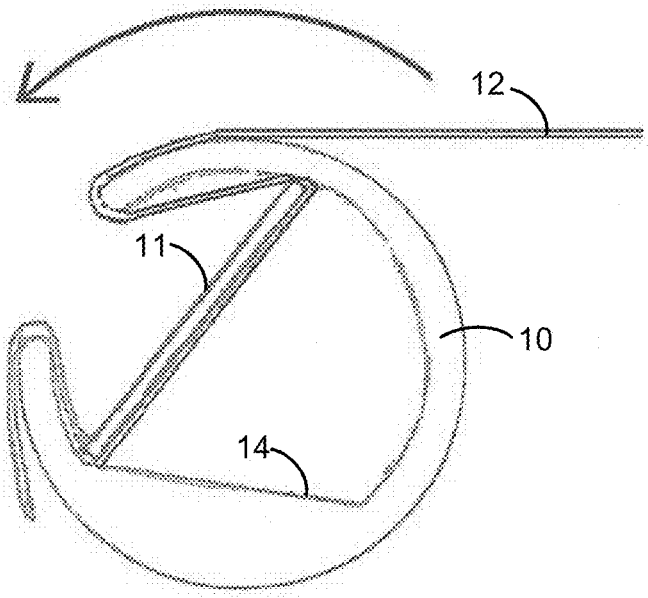

In operation, a tubular member 10, a locking member 11, and a fabric 12 are obtained. The fabric 12 is placed over the slot 13 of the tubular member 10, as shown in FIG. 1. The locking member 11 is then inserted into the slot 13 of the tubular member 10, which forces the fabric into the slot 13 with the locking member 11, as shown in FIG. 2. Once inserted, the locking member 11 is turned so that the one end of the locking member 11 abuts near or against the intersection of the protrusion 14 and the minor inner surface section 18. The locking member 11 may be turned by twisting the locking member 11, by pulling tension in the fabric, or both. The opposite end of the locking member 11 abuts against a point on the major inner surface section 16, while the fabric 12 is pinched between the tubular member 10 and the locking member 11, as shown in FIG. 3. The locking member 11 may be further turned in the desired direction, which causes the tubular member 10 to turn in the same direction and establish a tension in the fabric 12, as shown in FIG. 4. The tension in the fabric 12 pulls at the end of the locking member 11 abutting against the major inner surface section 16, which further locks the fabric 12 in the clamp.

In this respect, a clamp is provided that allows users to more easily secure the fabric 12 to the clamp by placing the fabric 12 inside the cylindrical tube 10 with the locking member 11. The weight or a pulling pressure applied to the fabric 12 will cause the locking member 11 to rotate in a first direction, e.g., counterclockwise, and pinch the fabric 12 between the locking member 11 and a flat portion 14 of the inner cavity. The security of this locking engagement can be enhanced by rotating the locking member 11 counterclockwise further. The fabric 12 may be released from the clamp by relieving the pressure between the locking member 11 and protrusion 14 of the inner cavity, aligning the locking member 11 with the slot 13, e.g. by turning the locking member 11 in an opposite direction, and removing the fabric 12 from the cavity thru slot 13.

Figure 5:
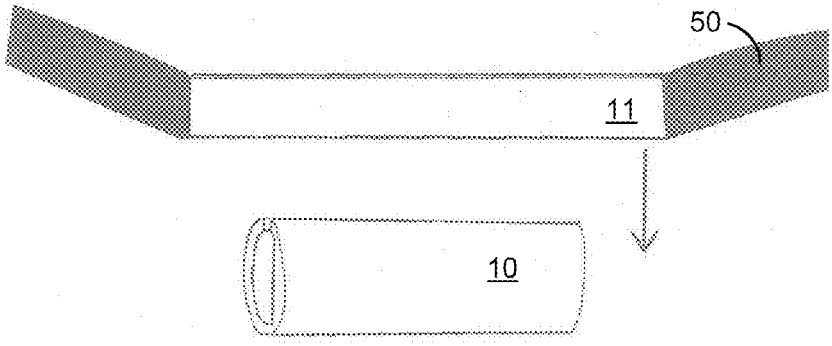
FIG. 5 to FIG. 6 is a front view of a clamp according to at least one embodiment of the clamps discussed herein.
Figure 6:
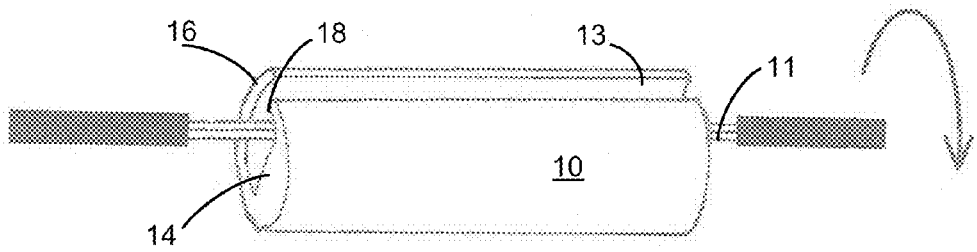
Figure 7:
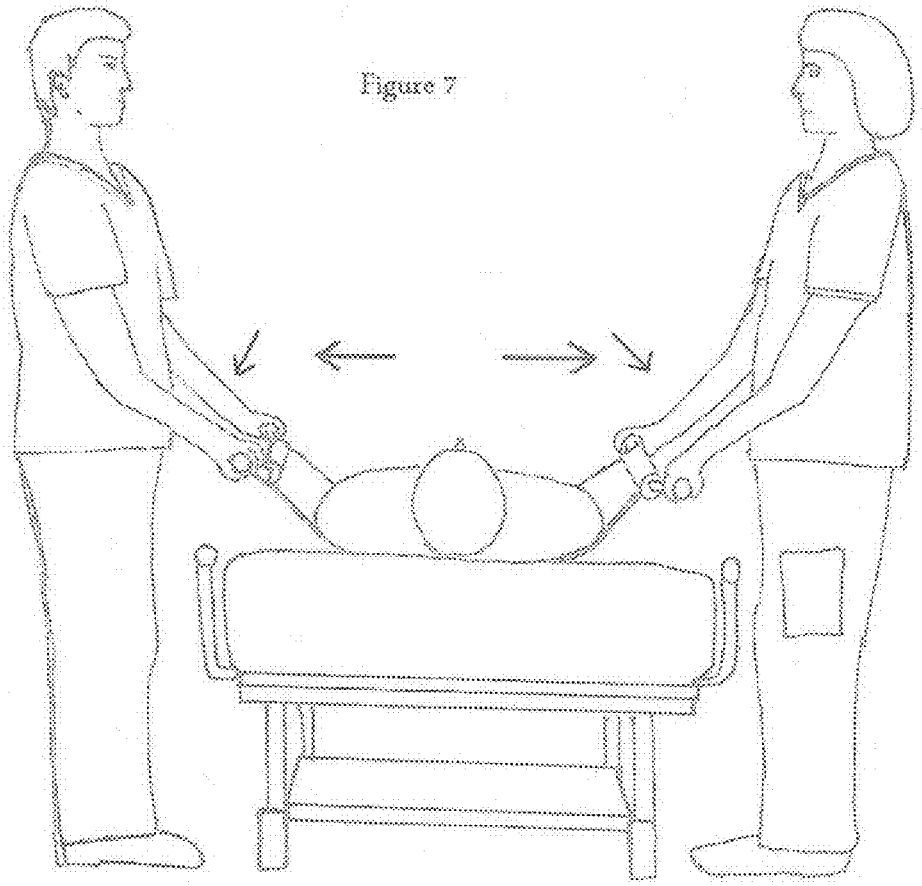
FIG. 7 to FIG. 8 depict the clamp according to at least one embodiment of the clamps discussed herein in use lifting and repositioning a patient, respectively.
Figure 8:
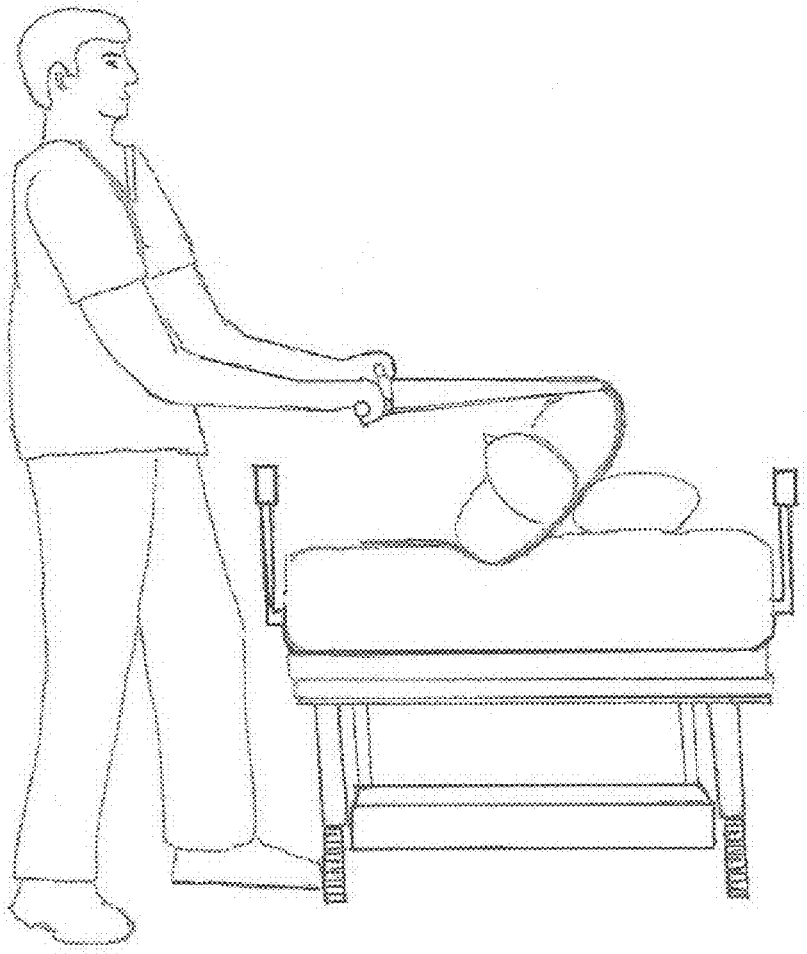
Figure 9:
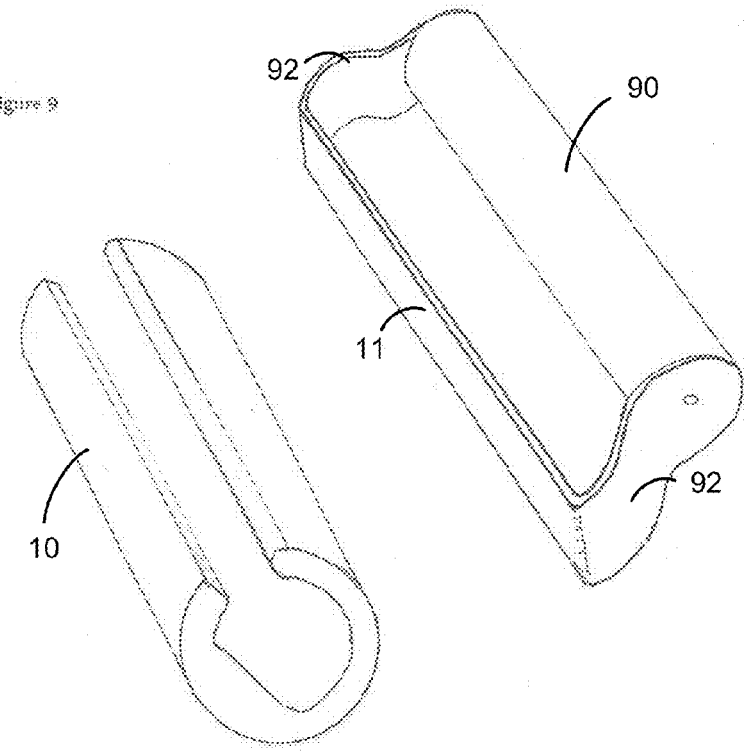
FIG. 9 to FIG. 14 are perspective and side views of a clamp according to at least another embodiment of the clamps discussed herein.

Referring to FIGS. 5-6, the locking member 11 may include a handle or handles 50 extending from one or each longitudinal end of the locking member 11. The handles allow users to grip the locking member 11 to better manage rotating and lifting patients as shown in FIGS. 7-8. The handles may be made of a flexible material and may be formed in a loop for users to place their hands there through. The clamp therefore allows staff to work with patients in a more upright position, which provides nursing staff better leverage for pulling the patient up in bed or for moving the patient from side to side. This reduces strain to back muscles by allowing staff to use their leg muscles in these activities thereby preventing, which prevents injury to the back as well as wrists, arms, and shoulders.

Figure 10:
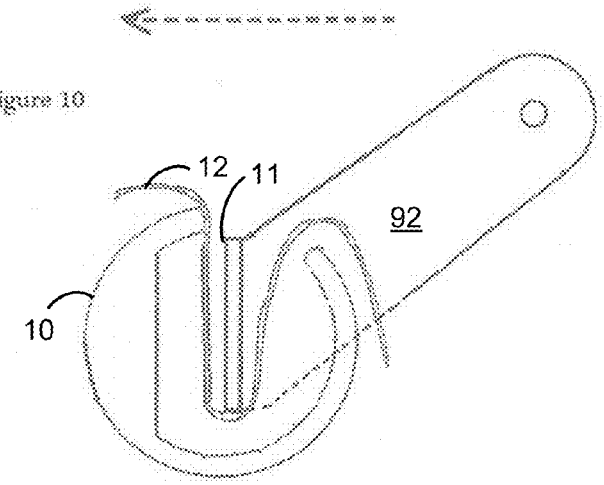

Referring to FIGS. 9 to 14, in at least one embodiment, the locking member 11 includes a single or multiple grip design. That is, in one embodiment, the locking member includes at least one grip 90, disposed between a pair of strut members 92, each extending from a longitudinally opposite end of the locking member 11. The grip 90 may be parallel with the axis of the tubular member 10 and/or the portion of the locking member 11 that gets inserted into the tubular member 10. In this instance, at least the portion of the locking member 11 that is inserted into the tubular member 10 has a planer surface and the strut members 92 extend out of the planer surface preferably at an angle e.g., less than or greater than 90 degrees, relative to thereto, as shown in FIG. 10. Therefore, the grip 90 extends above the planer surface of the locking member 11 and offset relative to the centerline of the planer surface.

Figure 11:
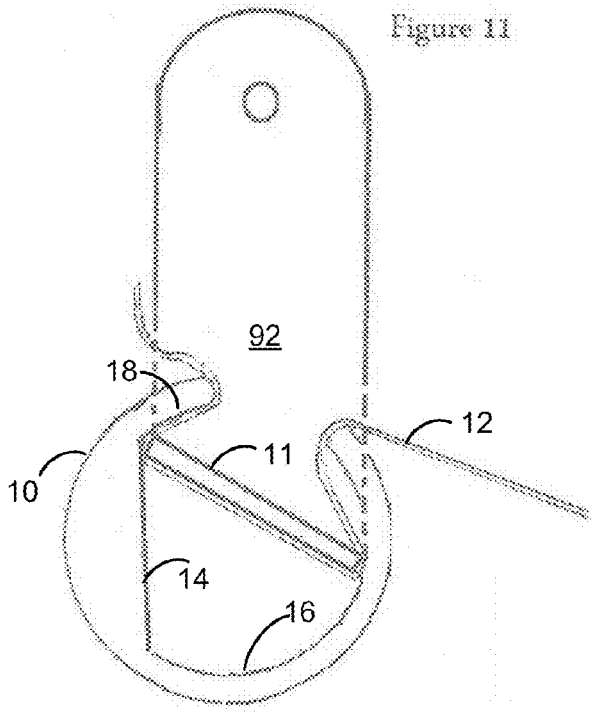
Figure 12:
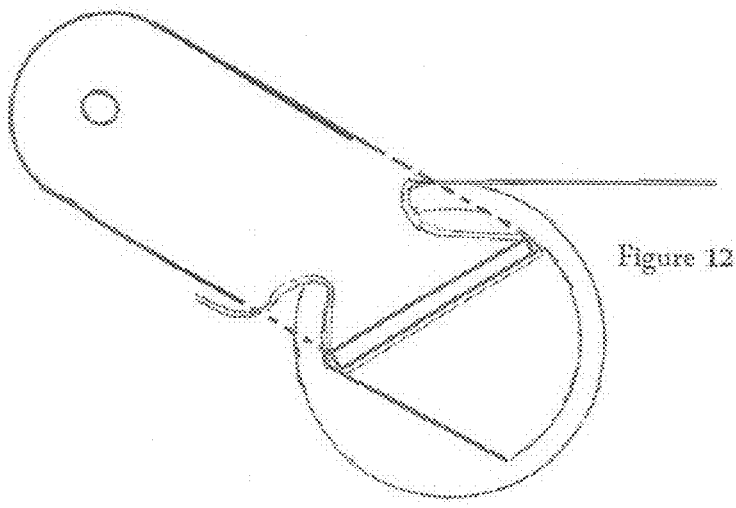
Figure 13:
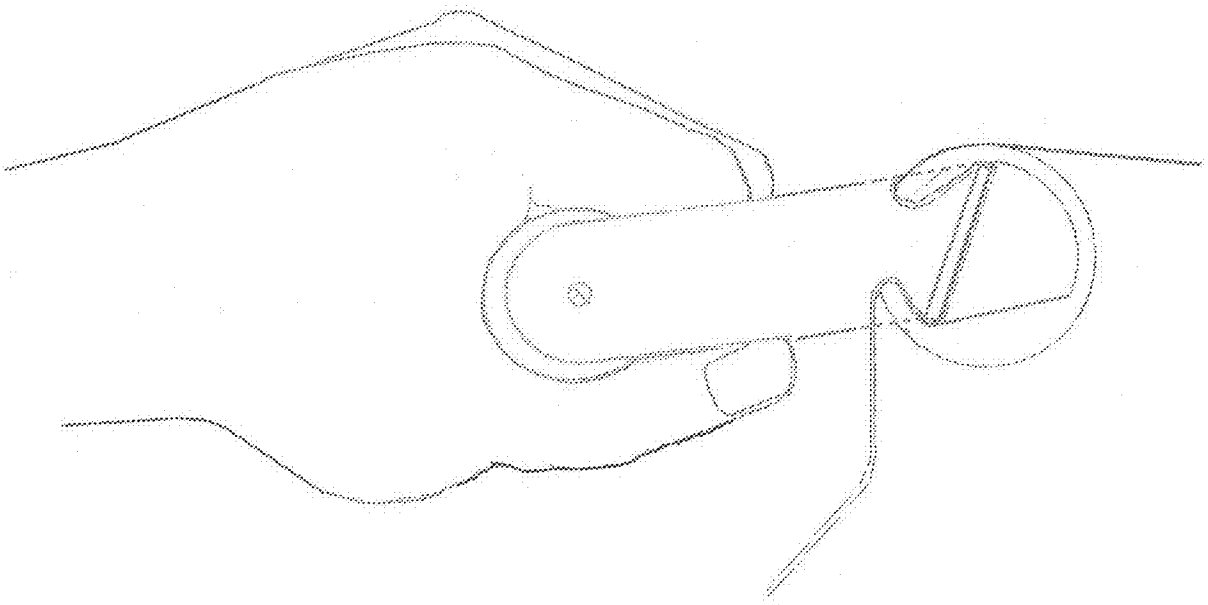
Figure 14:
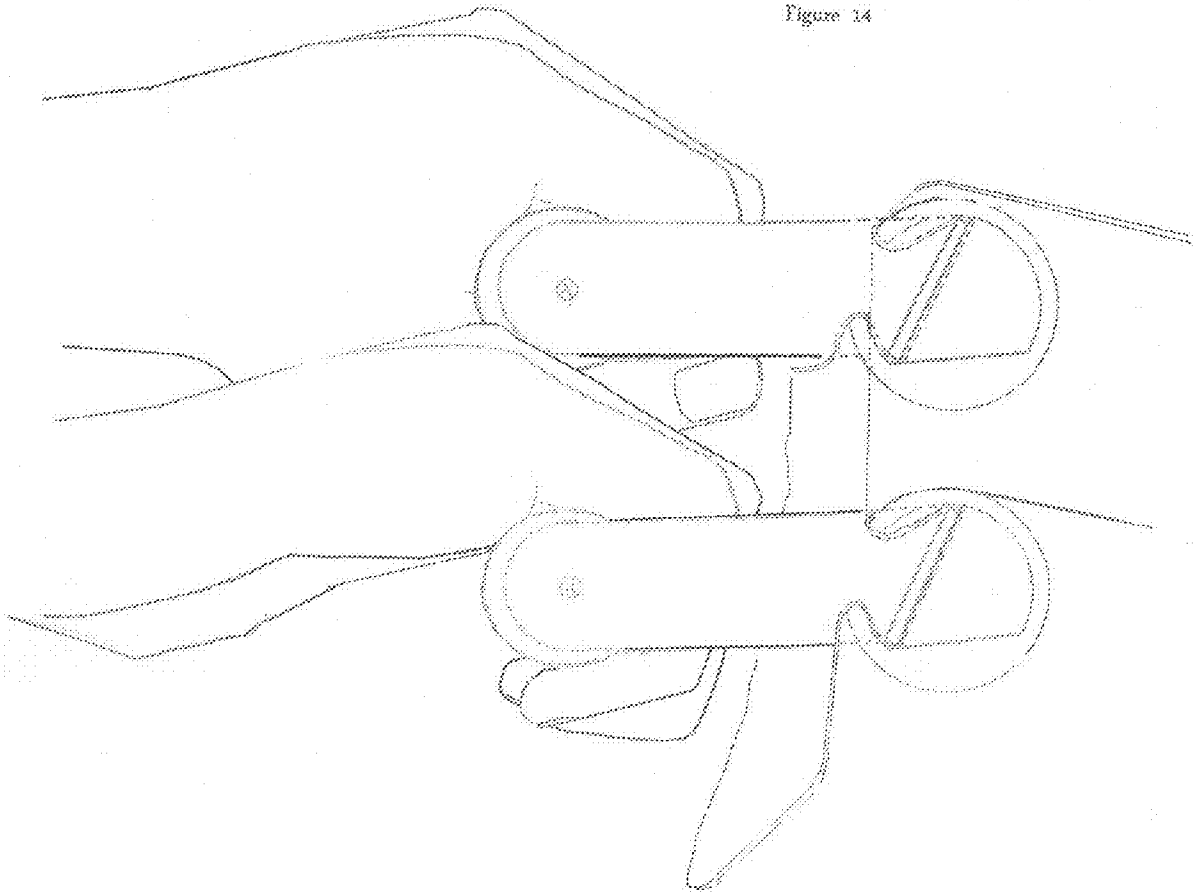

In practice, the locking member 11 is similarly inserted into the tubular member 10 with the fabric 12, as shown in FIG. 10. In this embodiment, the turning of the locking member 11 and likely the tubular member 10 is accomplished by pulling at the grip 90 in the desired direction. Once pulled, the locking member rotates in a direction so that one end of the locking member 11 pinches the fabric 12 against the intersection of the protrusion 14 and the minor inner surface section 18. The opposite end of the locking member 11 pinches the fabric 12 against the major inner surface section 16, as shown in FIG. 11. Additional force in the grip 90 causes the tubular member 10 to rotate, which creates a tension in the fabric 12, as shown in FIGS. 12-14. This embodiment generally provides better leverage for creating tension in the fabric 12. Multiple clamps may also be used, as shown in FIG. 14, which allows the user to pull at the fabric 12 with a wider gap between the hands.

Figure 16:
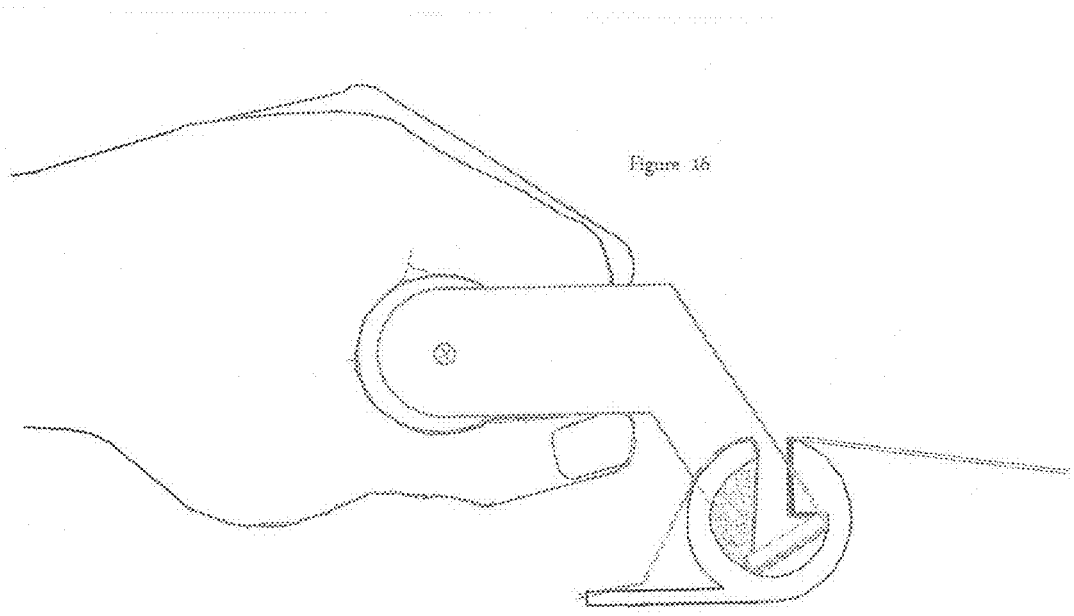
Figure 17:
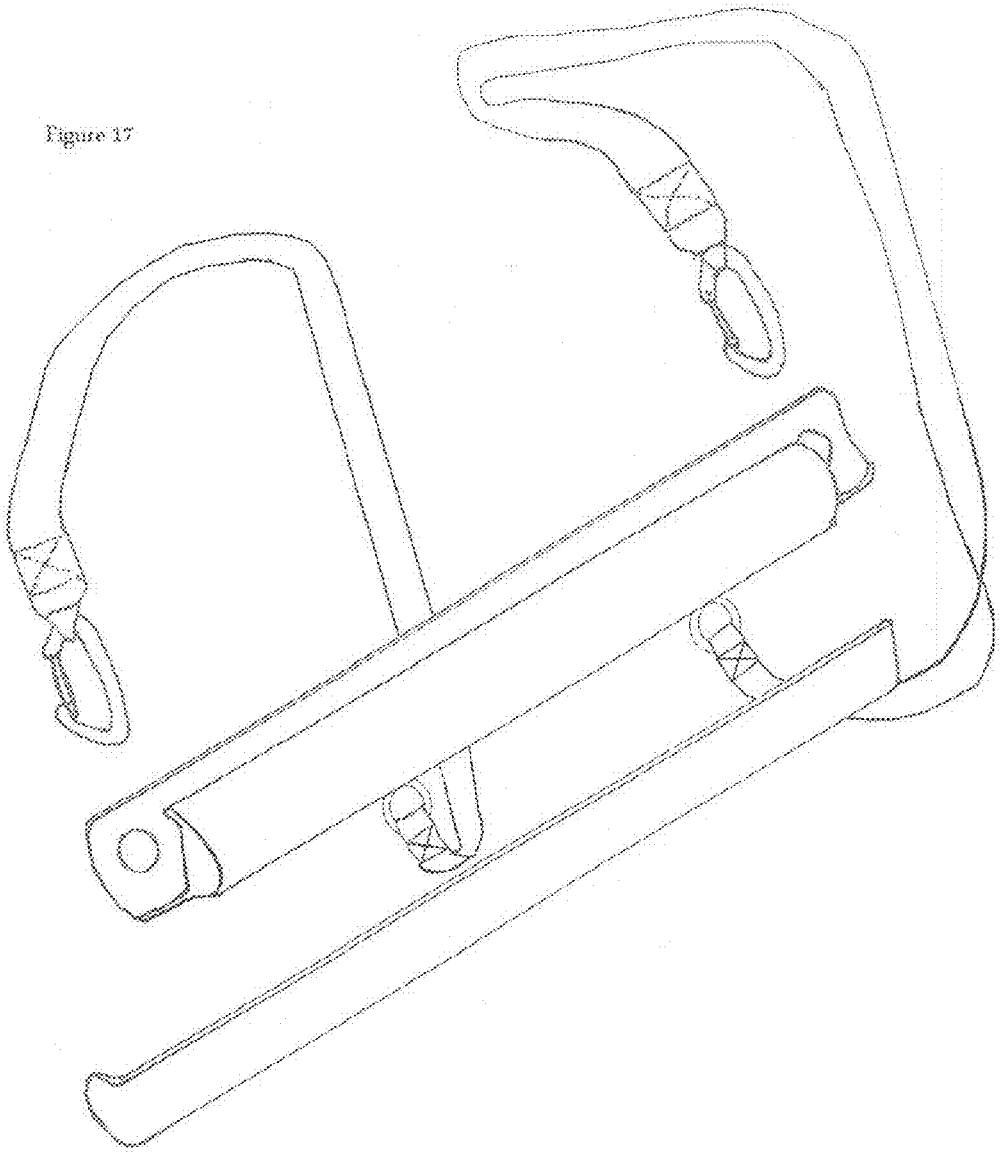
Figure 18A:
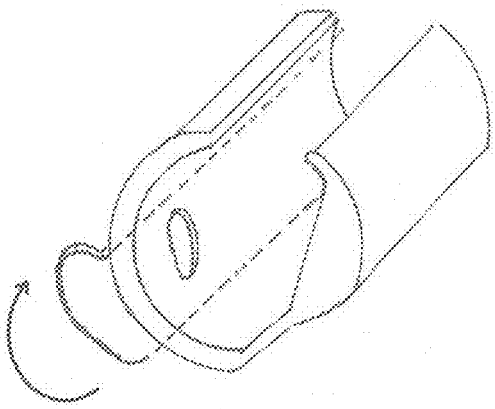
Figure 18B:
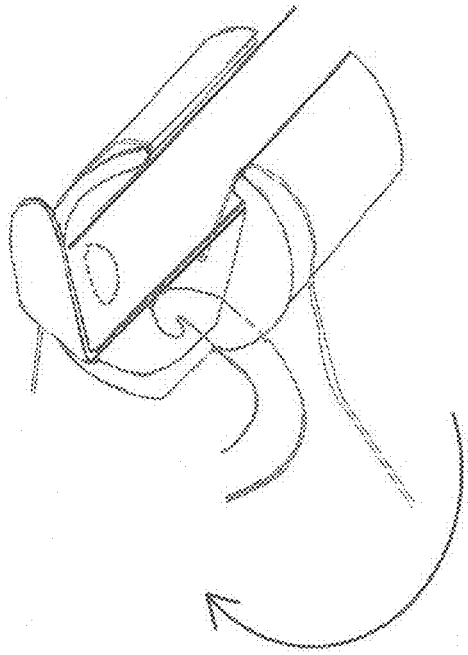
Figure 18C:
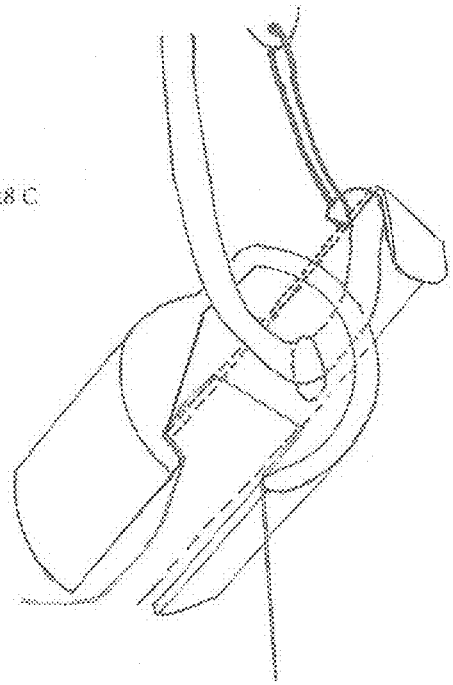

Referring to FIGS. 15A-16, in another embodiment, the tubular member 10 includes a flat base 150 that prevents the cylindrical shape of the tubular member 10 from rolling when placed on unstable surface like the edge of a bed. The flat base 150 is preferably essentially perpendicular or slightly offset with the slot 13. This allows the tubular member 10 to be placed on the bed or other surface and the fabric 12 inserted therein from the top. Notice the inclusion of a cushion 152 that is disposed within the void of the tubular member 10, which prevents the locking member 11 from jostling out of the tubular member 10. Also notice that the protrusion 14 begins at slot 13 and has a quarter pie-shape that holds the locking member 11 in place while the sheet clamp is being pulled. In this instance, one end of the locking member 11 pinches the fabric 12 at the intersection of the protrusion 14 and one side of the major inner surface section 16. The opposite end of the locking member 11 pinches the fabric 12 on another side of the major inner surface section 16, as shown in FIG. 15D. The cushion 152 and the locking member 11 may be sized such that turning the locking member 11 in the tubular member 10 causes the cushion 152 to deflect, as shown in FIG. 15C, until the locking member 11 is seated within the tubular member 10, as shown in FIG. 15D-16. The grip 90 may have a dogleg shape, as shown in FIGS. 15A and 16.

Figure 21:
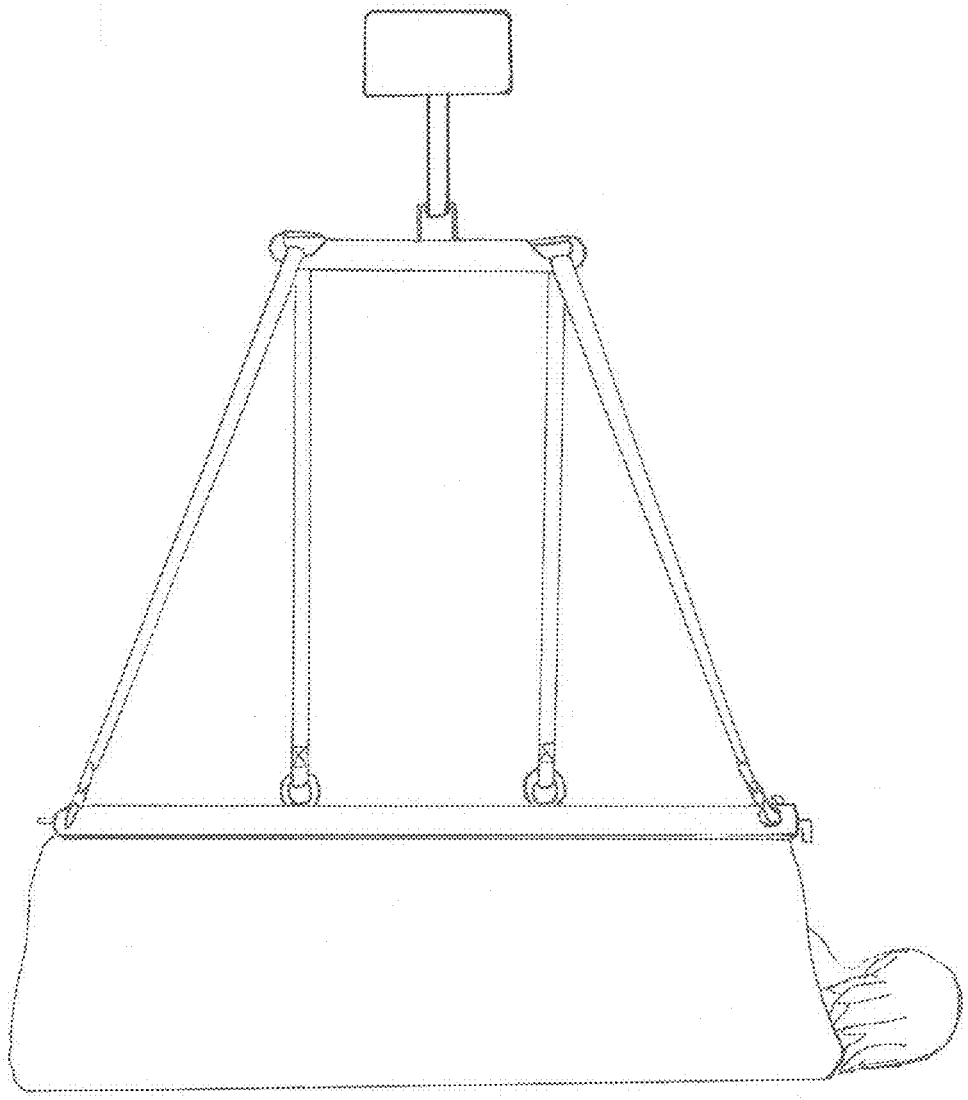

The single clamps shown in the previous embodiments are generally designed as smaller versions of the sheet clamp to allow caregivers to easily put them in their pocket. The size of the clamp may vary to lift greater loads. The clamp may also include holes or loops therein to attached lifting straps thereto, as shown in FIGS. 17-20B. The clamp may be worn by the user as shown in FIGS. 19 and 20A-20B, or it may be used on an existing ceiling lift as shown in FIG. 21. The straps may include loops for adjustment as shown in FIG. 20B.

Figure 22:
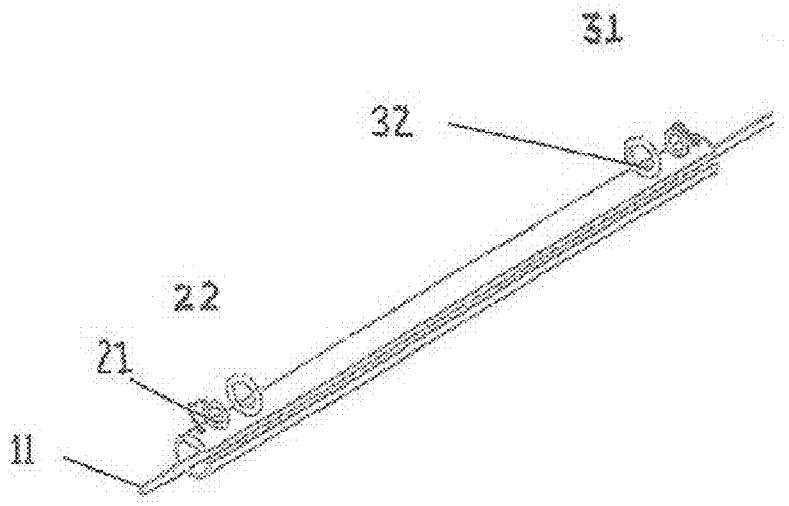
Figure 25:
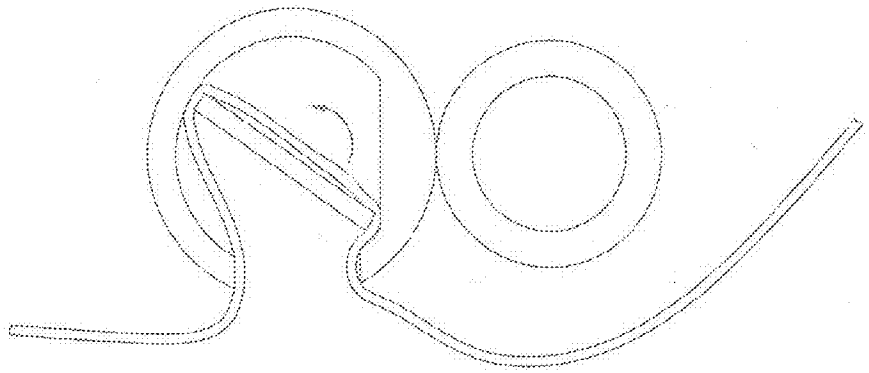
Figure 26:
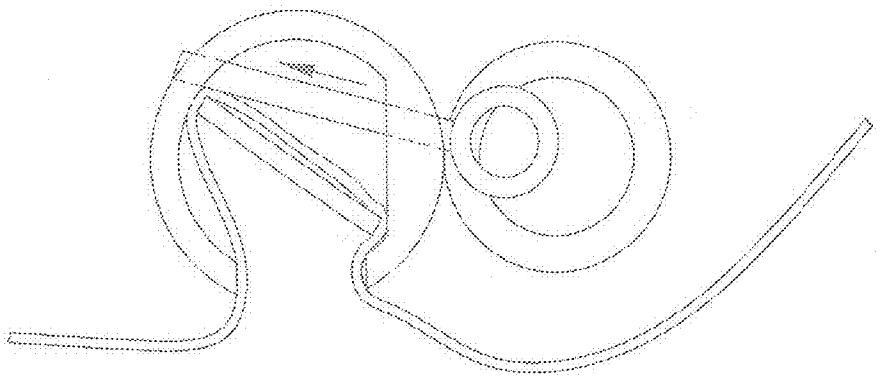

Referring to FIG. 22, in at least one embodiment the clamp includes an elongated cylindrical tubular member 10 and a slot 13 extending along its length for insertion of a fabric 12. The fabric clamp also includes an inner cavity extending through its length. In this instance, the tubular member 10 includes loops 32 attached thereto. The loops 32 may be parallel or perpendicular with the tubular member 10. The clamp may also include locking pins 21 at least one point in the tubular member 10. In this embodiment, the locking member 11 is inserted into the cavity of the tubular member and turned as shown in FIGS. 23-26 similar to the other embodiments disclosed herein. However, when the locking member 11 is turned into the final position within the cavity of the tubular member 10, the pin 21 may be inserted diagonally into the tubular member, e.g., through holes cross drilled there through, to keep the locking member 11 from turning in the opposite direction, as shown in FIG. 26.

In operation, a fabric 12 may be positioned into the slot 13 and into the cavity of the tubular member 10, as shown in FIG. 23. In FIG. 24 a locking member 11 is then positioned within the slot 13 so as to sandwich the fabric 12 between the inner wall of the cavity and the locking member 11. In this instance, the locking member 11 is generally a flattened, elongated member which is slightly longer than the cylindrical tube. In FIG. 25, after sandwiching the fabric 12, the locking member 11 may be turned in a direction to further secure the fabric 12 within the cavity of the fabric clamp. One edge of the locking member will rest on the flat portion of the inner cavity. In FIG. 26, a locking pin 21 is then placed in the aperture of the fabric clamp to lock the locking member 11 in place and prevent it from jostling or coming loose. To remove the fabric/cloth 12 from the fabric clamp, the locking pin 21 may be removed and the locking member 11 turned in a second direction and removed from the inner cavity through the slot 13. The fabric 12 may then be removed from the fabric clamp.

Figure 27:
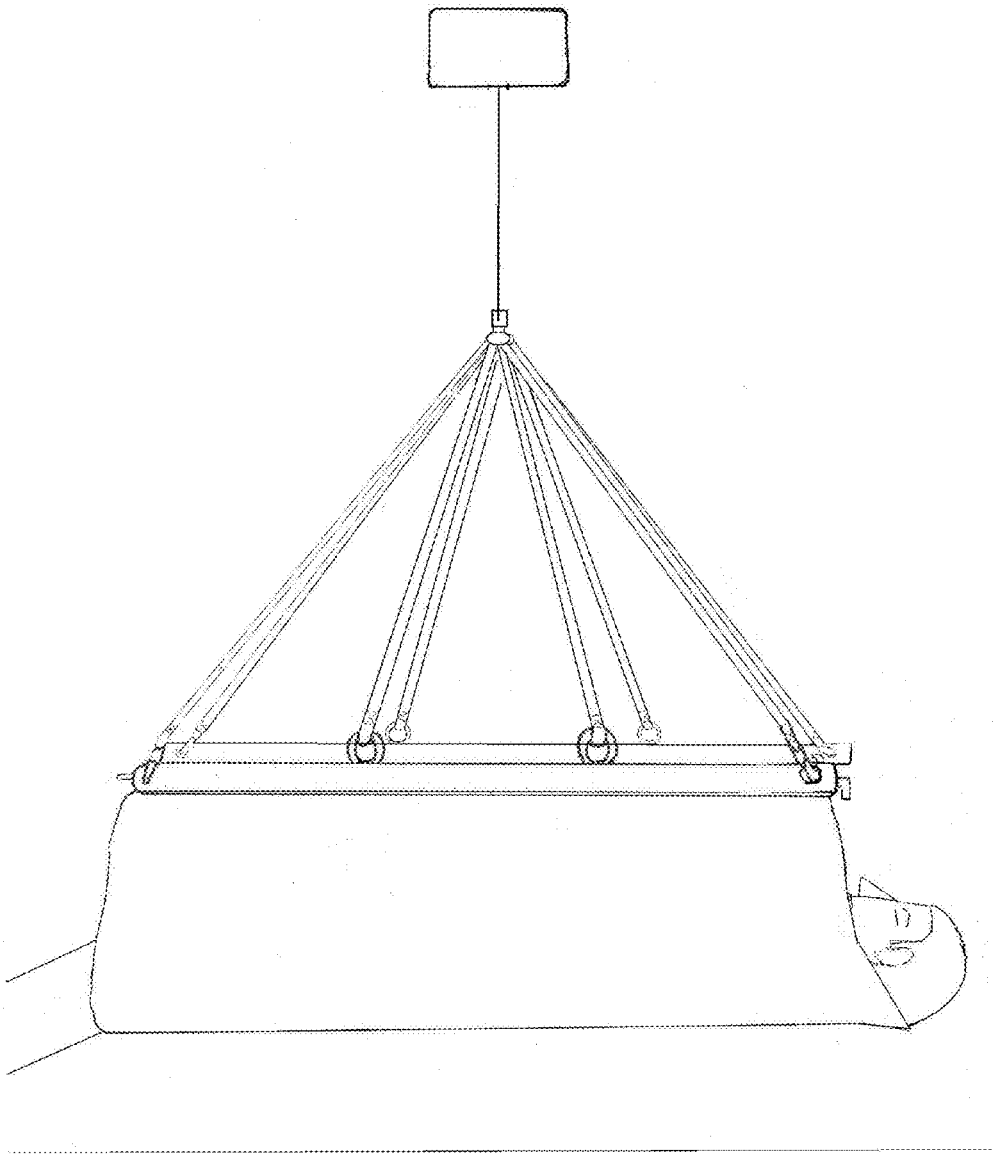
FIG. 27 depicts a plurality of clamps according to at least one embodiment of the clamps discussed herein in use lifting a patient.

FIG. 27 depict a plurality of clamps according to at least one embodiment of the clamps discussed herein in use lifting and repositioning a patient. As can be seen, a first clamp is attached to one side of the fabric sheet and another clamp is attached to the opposite side of the sheet. The each clamp includes a plurality of strap, each strap attached to a loop on the tubular member and the opposite end of the strap is removably coupled to a hole in the tubular member. The straps are connected at a common point to hoist the patient vertically.

The locking member 11 and the tubular member 10 may be comprised of various configurations and sizes, and maybe longer or shorter than the fabric clamp. The locking pin 21 may be comprised of various structures, though it is appreciated that an elongated pin 21 with a handle may be utilized as shown in FIG. 26. A chain may connect the locking pin 21 and the body of the clamp 10 to prevent the pin 21 from getting lost. On both ends of the tubular member 10, a connector, such as a metal ring (eyelet hook) may be fixedly attached to the fabric clamp, e.g., to the tubular member and/or the locking member. The rings may be used to connect the clamp to a lifting apparatus. These as well as other components discussed herein may be made of any material suitable for the loads anticipated, including metal, such as stainless steel, steel, aluminum, etc., plastic, rubber, or a combination thereof.

While the foregoing invention has been described in some detail for purposes of clarity and understanding, it will be appreciated from a reading of the disclosure that various changes in form and detail can be made without departing from the true scope of the invention.

What is claimed is:

1. A clamp comprising:

a tubular member, wherein the tubular member has:

an elongated tubular shape with a lengthwise slot disposed therein between a first end and a second end longitudinally opposite the first end, the slot having a width extending between a first longitudinal edge of the tubular member defining a first side of the slot and a second longitudinal edge of the tubular member defining a second side of the slot, a protrusion that extends out of an inner surface of a lengthwise cavity within the tubular member, the protrusion being offset with respect to the slot such that the protrusion is disposed within the tubular member closer to the first or second side of the slot to create an asymmetrical cross section in the tubular member; and a locking member, wherein the locking member has a thickness smaller than the width of the slot and a width greater than the width in the slot allowing the locking member to be inserted into and out of the slot in a first orientation but not in at least one other orientation.

2. The clamp of claim 1, wherein the tubular member has a cylindrical or rectangular tubular shape.

3. The clamp of claim 1, wherein the first and the second ends are open.

4. The clamp of claim 3, wherein the slot extends longitudinally along an entire length of the tubular member between the first and second openings.

5. The clamp of claim 1, wherein the slot is essentially parallel to a lengthwise axis of the tubular member.

6. The clamp of claim 1, wherein the locking member is a flattened, elongated bar having a length equal to or greater than a length of the tubular member.

7. The clamp of claim 1, wherein the inner surface of the tubular member is essentially circular, the protrusion extends outward from the essentially continuous inner surface, and wherein the locking member is inserted into the tubular member such that one end of the locking member abuts against an intersection of the protrusion and a major inner surface section, and another end of the locking member abuts against the major inner surface section at another point in the inner surface.

8. The clamp of claim 7, wherein the protrusion extends in a direction in line with the slot for the entire length of the tubular member.

9. The clamp of claim 1, wherein the locking member comprises at least one handle extending out of one longitudinal end of the locking member.

10. The clamp of claim 1, wherein the locking member comprises a pair of struts each extending out of a longitudinal end of the locking member and a grip disposed between the struts, wherein the locking member has a planar surface and wherein the pair of struts extend out of the planer surface at an angle so that the grip is above the planer surface and offset relative to a centerline of the planar surface.

11. The clamp of claim 1, wherein the tubular member comprises a flat base and wherein the slot is disposed in the tubular member vertically above the base.

12. The clamp of claim 1, wherein the tubular member comprises a cushion disposed within the cavity of the tubular member lengthwise opposite the protrusion.

13. The clamp of claim 1, further comprising a locking pin, and wherein the tubular member includes a pair of holes cross drilled therein to accept the locking pin and to lock the locking member in place within the cavity of the tubular member.

14. The clamp of claim 1, wherein the tubular member comprises at least one loop attached to the tubular member at a point on an outer surface of the tubular member opposite the protrusion.

15. A clamp comprising:

a tubular member, wherein the tubular member has:

an elongated tubular shape with a lengthwise slot disposed therein extending longitudinally along an entire length of the tubular member between a first open end and a second open end longitudinally opposite the first end, the slot having a width extending between a first longitudinal edge of the tubular member defining a first side of the slot and a second longitudinal edge of the tubular member defining a second side of the slot;

a protrusion that extends out of an inner surface of a lengthwise cavity within the tubular member, the protrusion being offset with respect to the slot such that the protrusion is disposed within the tubular member closer to the first or second side of the slot to create an asymmetrical cross section in the tubular member; and a locking member, wherein the locking member is a flat, elongated bar having a length equal to or greater than a length of the tubular member, a thickness smaller than the width of the slot, and a width greater than the width in the slot allowing the locking member to be inserted into and out of the slot in a first orientation but not in at least one other orientation.

16. A method of attaching a clamp comprising a tubular member and a locking member to a fabric, the method comprising:

positioning the tubular member having a lengthwise slot disposed therein extending longitudinally along an entire length of the tubular member between a first open end and a second open end longitudinally opposite the first end so that the slot faces upward, the slot having a width extending between a first longitudinal edge of the tubular member defining a first side of the slot and a second longitudinal edge of the tubular member defining a second side of the slot, the tubular member having a protrusion that extends out of an inner surface of a lengthwise cavity within the tubular member, the protrusion being offset with respect to the slot such that the protrusion is disposed within the tubular member closer to the first or second side of the slot to create an asymmetrical cross section in the tubular member;

positioning the fabric above the slot in the tubular member;

inserting the fabric into the tubular member with the locking member having a length equal to or greater than a length of the tubular member, a thickness smaller than the width of the slot, and a width greater than the width in the slot; and turning in a first direction the tubular member therewith pinching the fabric between one end of the locking member and an intersection of the protrusion and a major inner surface section, and another end of the locking member and at another point on the major inner surface section.

17. The method of claim 16, comprising turning the locking member further in the first direction therewith causing the tubular member to rotate and pull a tension in the fabric.

18. The method of claim 16, comprising turning the locking member in an opposite direction of the first direction therewith releasing the fabric from the clamp.

* * * * *